US010895105B1

(12) United States Patent
Marchese

(10) Patent No.: US 10,895,105 B1
(45) Date of Patent: Jan. 19, 2021

(54) ELECTRICALLY DUAL POWERED WINDOW COVERING ASSEMBLY

(71) Applicant: Anthony Marchese, Fort Lauderdale, FL (US)

(72) Inventor: Anthony Marchese, Fort Lauderdale, FL (US)

( * ) Notice: Subject to any disclaimer, the term of this patent is extended or adjusted under 35 U.S.C. 154(b) by 118 days.

(21) Appl. No.: 15/588,283

(22) Filed: May 5, 2017

Related U.S. Application Data

(60) Provisional application No. 62/332,257, filed on May 5, 2016.

(51) Int. Cl.
*E06B 9/68* (2006.01)
*E06B 9/322* (2006.01)

(52) U.S. Cl.
CPC ..... *E06B 9/322* (2013.01); *E06B 9/68* (2013.01)

(58) Field of Classification Search
CPC . E06B 9/262; E06B 9/322; E06B 9/68; E06B 2009/262; E06B 9/70; E06B 9/88
See application file for complete search history.

(56) References Cited

U.S. PATENT DOCUMENTS 3,814,164 A * 6/1974 Kuss ..... E06B 3/01 160/120
4,979,552 A * 12/1990 van der Zanden ..... E06B 9/264 160/107
5,467,808 A * 11/1995 Bell ..... E06B 9/32 160/168.1 P
5,793,174 A * 8/1998 Kovach ..... E06B 9/262 318/16
6,082,433 A * 7/2000 Vafaie ..... E06B 9/68 160/310
10,458,178 B2 * 10/2019 Hall ..... E06B 9/32
2003/0098133 A1 * 5/2003 Palmer ..... E06B 9/68 160/310
2007/0284053 A1 * 12/2007 Mullet ..... E06B 9/42 160/31
2010/0006240 A1 * 1/2010 Cieslik ..... E06B 9/322 160/405
2010/0319860 A1 * 12/2010 DeWard ..... E06B 9/322 160/315
2011/0061818 A1 * 3/2011 Geriniere ..... E06B 9/322 160/168.1 P
2011/0253320 A1 * 10/2011 Baugh ..... E06B 9/262 160/127

(Continued)

*Primary Examiner* — Daniel P Cahn
(74) *Attorney, Agent, or Firm* — David P. Lhota, Esq.; Lhota & Associates, P.A.

(57) ABSTRACT

An electrically dual motor powered window cover assembly operational on a single shaft supporting an extendable and retractable window covering, control motor, a slave motor, two cord spools, two cords, a stop assembly and a power cable wired with reverse polarity between the control and slave motors. An offset gearbox may be included to offset the reverse rotation of the slave motor to allow the control and slave motors to be wired with the same polarity. A pair of lifting gear boxes may be mounted to the shaft proximal opposite ends of the shaft to assist in the lifting of a heavier window covering. The assembly may include a wireless remote control transmitter for operating the two DC motors and electrical and mechanical circuitry adapted to store positional information.

20 Claims, 4 Drawing Sheets

(56) References Cited

U.S. PATENT DOCUMENTS

| | | | | |
|---|---|---|---|---|
| 2012/0200247 | A1* | 8/2012 | Baugh | G05B 19/042 318/468 |
| 2013/0112357 | A1* | 5/2013 | Gontarski | E06B 9/13 160/291 |
| 2014/0163742 | A1* | 6/2014 | Element | E06B 9/32 700/275 |
| 2014/0311685 | A1* | 10/2014 | Schoch | E06B 9/26 160/84.02 |
| 2015/0033910 | A1* | 2/2015 | Steenbergen | E06B 9/307 74/99 R |
| 2015/0284990 | A1* | 10/2015 | Hall | E06B 9/72 74/606 R |
| 2015/0288316 | A1* | 10/2015 | Hall | G01R 19/0092 318/434 |
| 2016/0017656 | A1* | 1/2016 | Adreon | E06B 9/322 160/7 |
| 2016/0143470 | A1* | 5/2016 | Mullet | A47H 1/102 160/331 |
| 2016/0222726 | A1* | 8/2016 | Rupel | E06B 9/66 |
| 2016/0258213 | A1* | 9/2016 | Cavarec | E06B 9/322 |
| 2017/0067286 | A1* | 3/2017 | Hall | E06B 9/308 |
| 2017/0075183 | A1* | 3/2017 | Brown | E06B 9/24 |
| 2017/0201140 | A1* | 7/2017 | Cole | E06B 9/13 |
| 2017/0328130 | A1* | 11/2017 | Baker | E05B 47/0012 |
| 2018/0128032 | A1* | 5/2018 | Karle | E05D 15/262 |
| 2018/0163462 | A1* | 6/2018 | Duan | E06B 9/384 |
| 2018/0187485 | A1* | 7/2018 | Gomaa | E06B 9/42 |
| 2018/0252036 | A1* | 9/2018 | Rivera | E06B 9/72 |
| 2018/0313140 | A1* | 11/2018 | Rejc | E06B 9/15 |
| 2019/0071926 | A1* | 3/2019 | Hall | E06B 9/368 |
| 2019/0119978 | A1* | 4/2019 | Hall | H04L 12/282 |
| 2019/0309559 | A1* | 10/2019 | Hall | E05F 15/40 |

* cited by examiner

ELECTRICALLY DUAL POWERED WINDOW COVERING ASSEMBLY

CROSS-REFERENCE TO RELATED APPLICATION

This application claims the benefit of provisional patent application Ser. No. 62/332,257 filed May 5, 2016.

STATEMENT REGARDING FEDERALLY SPONSORED RESEARCH OR DEVELOPMENT

N/A

FIELD OF THE INVENTION

The present invention relates to electrically powered window coverings, such as vertically adjustable shades, tiltable blinds and the like, and more particularly, to a dual-motorized window covering assembly having two motors to extend and lift longer window coverings used in larger window openings that cannot be lifted by a single motor effectively, efficiently and smoothly. The present invention may have a wireless remote control transmitter for operating two DC motors and electrical and mechanical circuitry adapted to store positional information.

BACKGROUND OF THE INVENTION

Wired and wireless battery-operated window covering assemblies are known in the industry, such as disclosed in U.S. Pat. No. 5,793,174. These window coverings have a head rail in which all the components are housed, including a battery pack, an interface module including an IR receiver and a manual switch, a processor board including control circuitry, motor, drive gear, and a rotatably mounted reel on which lift cords wind and unwind a collapsible shade. These assemblies typically include a lift cord detector which gauges shade status to control the raising and lowering of the shade, and a rotation sensor which, in conjunction with internal registers and counters, keeps track of travel limits and shade position.

The problem with conventional battery-operated window covering assemblies is that they lack sufficient power to lift shades beyond a certain length, or to at least lift them efficiently, effectively and smoothly without struggling. Accordingly, two shade systems must be used in larger window openings, which compromises the aesthetics of a room and is more expensive for the consumer. The window covering industry has been trying to develop a battery-operated window covering system powerful enough to extend and lift larger and heavier window coverings without compromising the look, appeal and physical size of the head rail or housing but to no avail. Thus, if there existed battery-operated window covering system that was powerful enough to efficiently, effectively and smoothly extend and lift a shade or other window covering or to lift and extend without struggling regardless of the size, length and weight of the window covering, it would be well received. However, there are no known battery-operated window covering systems known.

It is therefore desirable to have battery-operated window covering assembly powerful enough to efficiently, effectively and smoothly extend and lift a window covering, such as a shade or blinds, efficiently, effectively and smoothly or to do so without struggling regardless of the size, length or weight of the window covering. If there existed such a system or assembly, it would address the foregoing shortcomings in the background art. As there are no known battery-operated window covering systems or assemblies that operate without failing or diminished performance when lifting shades or other window coverings that exceed a specific length, size or weight, there exists a need for such a system or assembly. It is, therefore, to the effective resolution of the aforementioned problems and shortcomings of the prior art that the present invention is directed. The instant invention addresses this unfulfilled need in the prior art as contemplated by the instant invention disclosed.

SUMMARY OF THE INVENTION

In light of the foregoing, it is an object of the present invention to provide an electrically dual motor powered window cover assembly for extending and lifting large window coverings over correspondingly large windows that typically require two adjacent window coverings.

It is also an object of the instant invention to provide an electrically dual motor powered window cover assembly operational by a wireless remote control transmitter device that can simultaneously operate two direct current (DC) motors.

It is another object of the instant invention to provide an electrically dual motor powered window cover assembly having electrical and mechanical circuitry adapted for storing positional information.

It is an additional object of the instant invention to provide an electrically dual motor powered window cover assembly operational on a single shaft wherein the motor-to-motor power cable is wired with reverse polarity.

It is a further object of the instant invention to provide an electrically dual motor powered window cover assembly operational on a single shaft and having an offset gear box and motor-to-motor power cable wired conventionally with the same polarity.

It is yet another object of the instant invention to provide electrically dual motor powered window cover assembly operational on a single shaft with at least one additional gear box for lifting and extending heavier or larger shades.

It is yet a further object of the instant invention to provide an electrically dual motor powered window cover assembly operational on a single shaft and having an offset gear box and at least one additional gear box for lifting and extending heavier or larger shades.

In accordance with one aspect, the present invention provides an electrically dual motor powered window cover assembly operational on a single shaft supporting a window covering, control motor, a slave motor, at least one cord spool, a stop assembly and a power cable wired with reverse polarity between the control and slave motors. The assembly may include a wireless remote control transmitter for operating the two DC motors and electrical and mechanical circuitry adapted to store positional information.

In another aspect, the present invention an electrically dual motor powered window cover assembly operational on a single shaft supporting a window covering, control motor, a slave motor, an offset gearbox, at least one cord spool, a stop assembly and a power cable wired with the same polarity between the control motor and slave motor. The assembly may include a wireless remote control transmitter for operating the two DC motors and electrical and mechanical circuitry adapted to store positional information.

In an additional aspect, the present invention provides an electrically dual motor powered window cover assembly operational on a single shaft supporting a window covering, control motor, a slave motor, a first gear box, a second gear box, at least one cord spool, a stop assembly and a power cable wired to the slave motor and control motor with reverse polarity. The assembly may include a wireless remote control transmitter for operating the two DC motors and electrical and mechanical circuitry adapted to store positional information.

In a further aspect, the present invention an electrically dual motor powered window cover assembly operational on a single shaft supporting a window covering, control motor, a slave motor, an offset gearbox, a first lift gear box, a second lift gear box, at least one cord spool, a stop assembly and a power cable wired to the control motor and slave motor with the same polarity. The assembly may include a wireless remote control transmitter for operating the two DC motors and electrical and mechanical circuitry adapted to store positional information.

In accordance with these and other objects, which will become apparent hereinafter, the instant invention will now be described with particular reference to the accompanying drawings.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

With reference to the drawings in which like reference designators refer to like elements, FIGS. 1 to 6 depict the preferred and alternative embodiments of the instant invention which is generally referenced as a dual powered window covering assembly, dual powered window shade assembly, window covering assembly, window shade assembly, assembly, system and, or by numeric character 10. The instant invention 10 is primarily described with reference to extending and lifting a window shade 1, but may be adapted for operating other types of window coverings, such as blinds and other known window coverings that are typically extended and retracted manually by cords.

Figure 1:
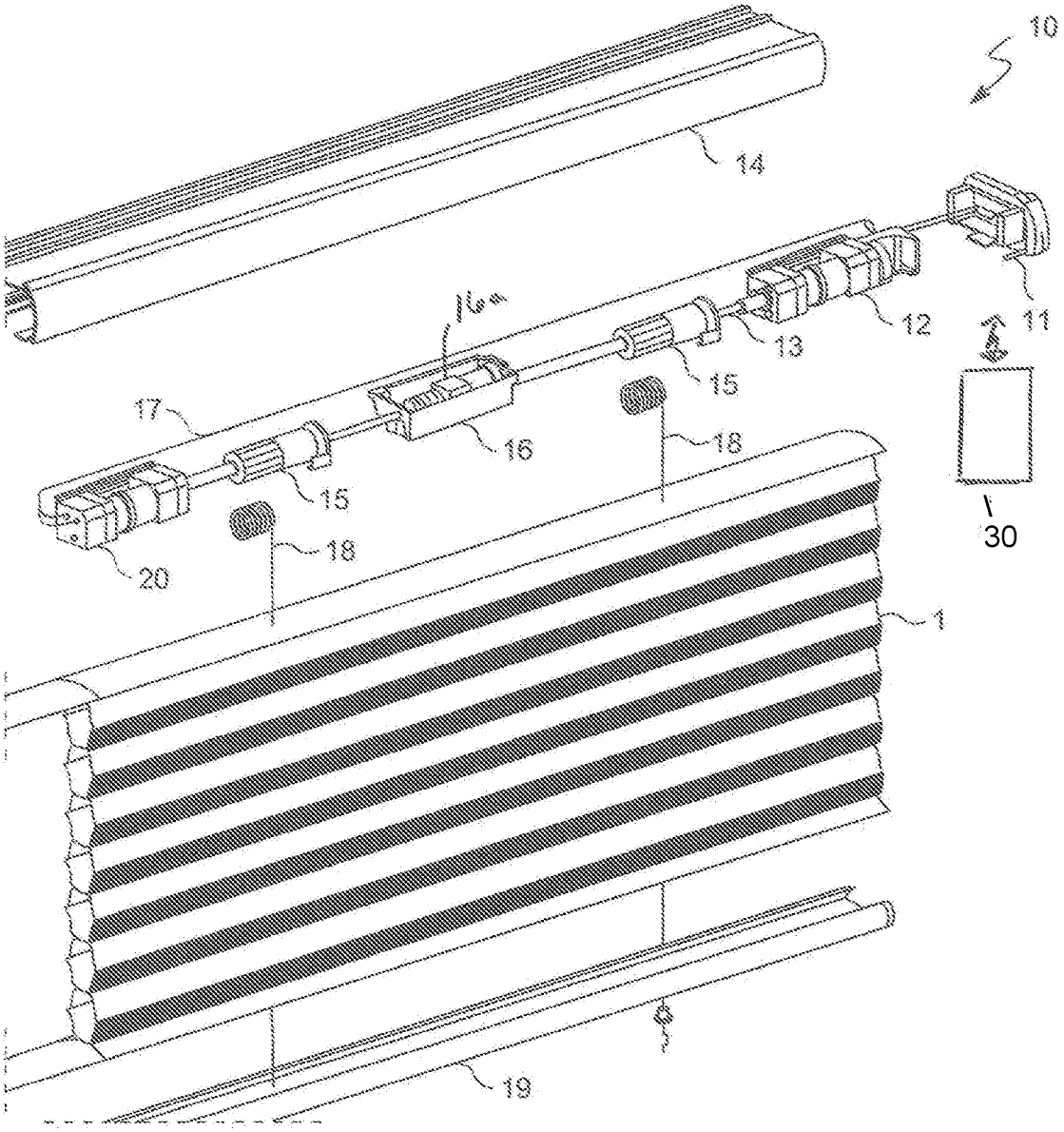
FIG. 1 is front perspective view of the electrically dual powered window covering assembly in accordance with the principles of the present invention.
Figure 2:
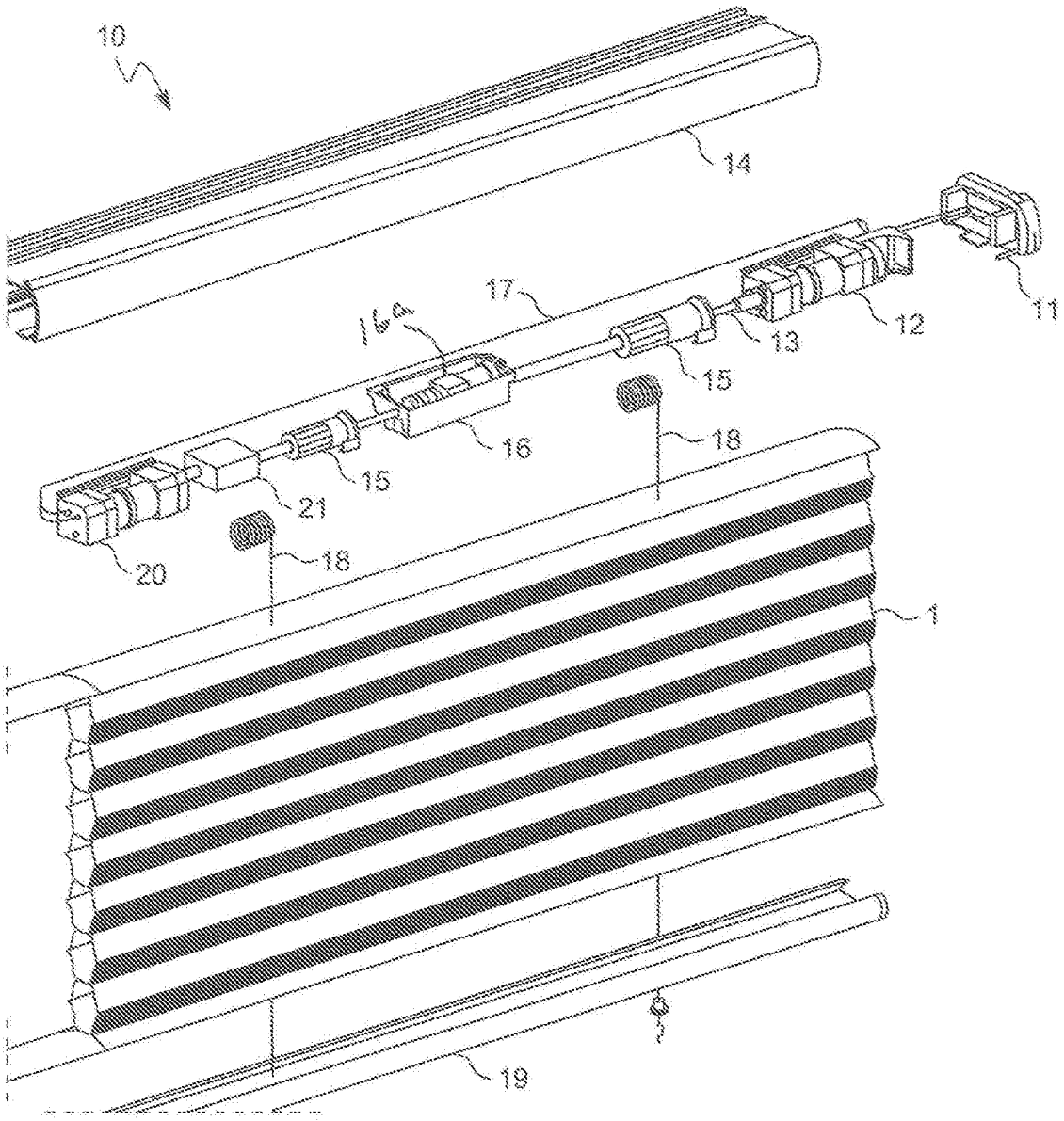
FIG. 2 is a front perspective view of the electrically dual powered window covering assembly in accordance with an alternative embodiment of the present invention.
Figure 3:
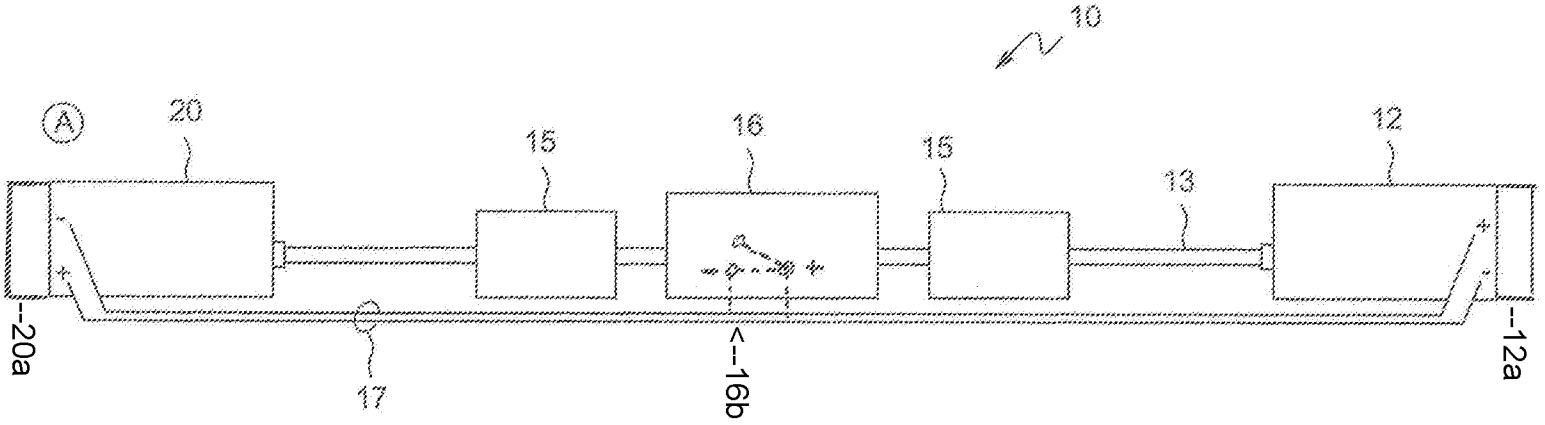
FIG. 3 is a block diagram of the electrically dual powered window covering assembly of FIG. 1.

Referring to FIGS. 1-6, the instant invention 10 provides an electrically powered window covering assembly having two motors 12, 20 and at least one chord 18 in mechanical communication with the assembly 10 that provides more power for extending and lifting longer and heavier window shades 1. There is shown in FIGS. 1 and 3 a first embodiment of the instant invention 10 having a receiver 11, control motor 12, steel shaft 13, head rail cover 14, a pair of cord spools 15, limit or stop assembly or device 16, motor-to-motor power cable 17, at least one and preferably two lift cords 18, bottom rail 19 and slave motor 20. The control motor 12 and slave motor 20 are mechanically coupled from their output to opposite ends of the steel shaft 13 and electrically coupled by the power cable 17 to receive power from a power source to drive the pair of cord spools 15. The power cable 17 has positive and negative wires electrically connected to the control motor 12 and slave motor 20. The positive and negative wires of the power cable 17 are reversed on the slave motor 20, as shown in FIG. 3, to electrically synchronize its direction of rotation to the control motor 12 so they rotate in the same direction. The control motor 12 is electrically coupled to a receiver 11, which receives wireless signals remotely from a wireless remote control transmitter 30 for operating the control motor 12. The stop assembly 16 is mounted on the steel shaft 13 between the motors 12, 20 and has a limit spool 16*a* that acts like a limit switch to stop the motors 12, 20 when the shade 1 is fully extended or retracted. The stop assembly 16 is keyed to the shaft 13 such that it rotates with the shaft 13 causing the limit spool 16 *b* to travel in the stop assembly 16 until it reaches either end causing the motors 12, 20 to stop, such as by removing power from the motors. The limit spool 16 *a* acts as a switch to remove power from or stop the motors 12, 20. The stop assembly 16 may alternatively include an electrical or mechanical limit switch 16*b* for causing the motors 12, 20 to stop, such as by removing power from the motors. A cord spool 15 is mounted to the shaft 13 on opposite sides of the stop assembly 16 for winding and unwinding a pair of high strength cords 18 when the control motor 12 is operated in forward and reverse directions. The slave motor 20 follows the control motor 12 and receives a reverse polarity signal from the receiver 11 such that it rotates in the same direction as the control motor 12. The control motor 12 and slave motor 20 are preferably DC motors powered by a DC power source such as batteries 12*a* and 20*a*, respectively. Alternatively, the control motor 12 and slave motor 20 may be alternating current (AC) motors that are powered by an AC power source.

Figure 4:
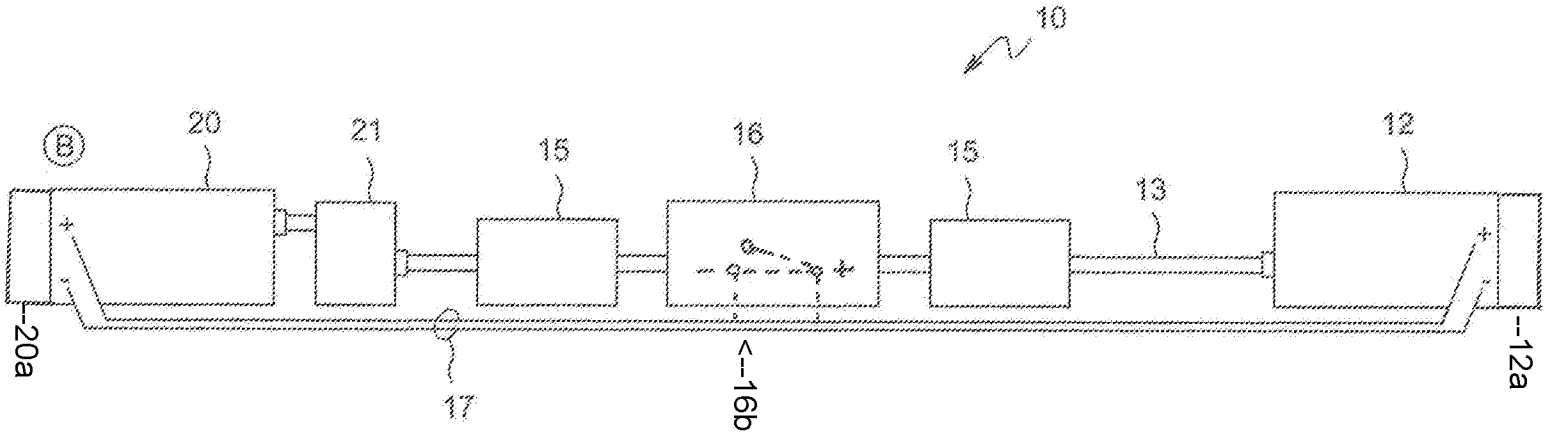
FIG. 4 is a block diagram of the electrically dual powered window covering assembly of FIG. 2.

With reference to FIGS. 2 and 4, in an alternative embodiment of the instant invention, the dual powered window shade system 10 includes a receiver 11, control motor 12, steel shaft 13, head rail cover 14, a pair of cord spools 15, limit or stop assembly 16, motor-to-motor power cable 17, at least one and preferably two lift cords 18, bottom rail 19, slave motor 20 and offset gearbox 21. The alternative embodiment of the system 10 is assembled in the same way as the first embodiment shown in FIGS. 1 and 3, except with respect to the addition of an offset gearbox 21 and the wiring of the slave motor 20. The offset gear box 21 is coupled to the slave motor 20 on one side and to the steel shaft 13 on the opposite side to mechanically synchronize the direction of rotation of the slave motor 20 with the control motor 12. In this embodiment, the positive and negative wires in the power cable 17 are connected to the positive and negative terminals of the control motor 12 and slave motor 20 without reversing polarity. The receiver 11 receives a wireless signal from the wireless remote control transmitter 30 for applying and removing power to the motors 12, 20 controlling the direction of rotation of the motor 12 and shaft 13 in extending and retracting the shade 1 or other type of window covering.

Figure 5:
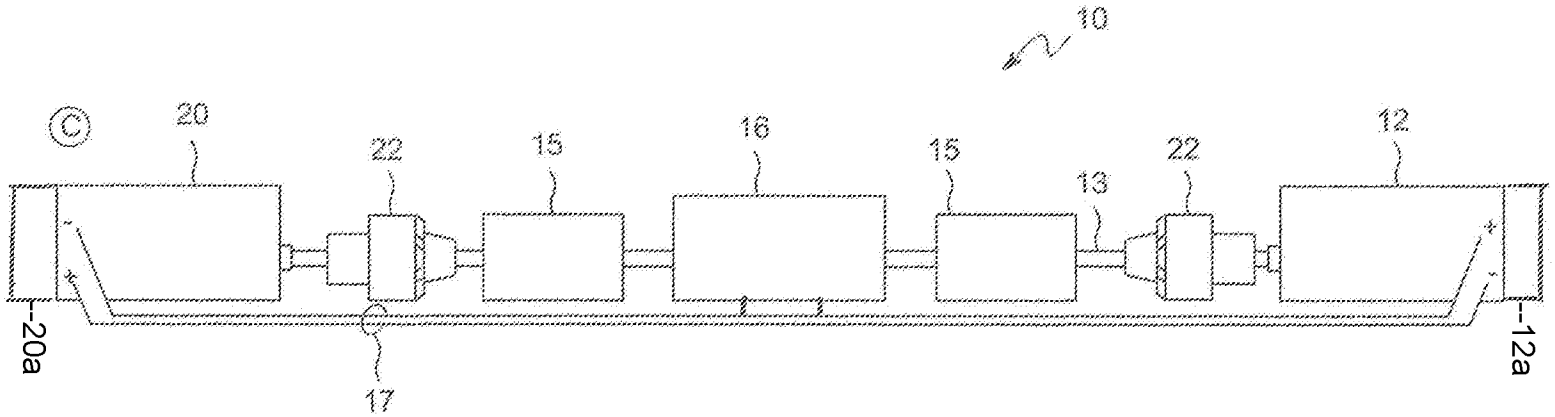
FIG. 5 is a block diagram of the electrically dual powered window covering assembly FIG. 1 with an additional gear box for larger shades or window coverings.
Figure 6:
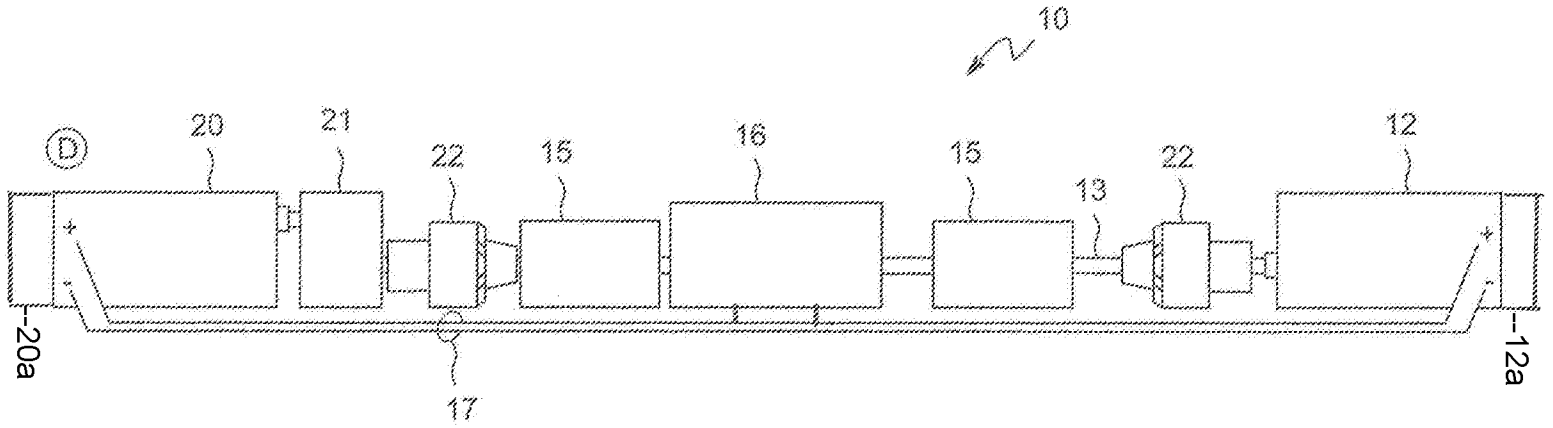
FIG. 6 is a block diagram of the electrically dual powered window covering assembly of FIG. 2 with an additional gear box for larger shades or window coverings.

Now referring to FIG. 5, the dual powered window shade system 10 of FIGS. 1 and 3 includes at least one and preferably a pair of auxiliary gearboxes 22. A control side auxiliary gearbox 22 is coupled to the control motor 12 on one side and the steel shaft 13 on the other side and a slave side auxiliary gearbox 22 coupled to the slave motor 20 on one side and the steel shaft 13 on the opposite side. The auxiliary gearboxes 22 provide an additional mechanical leverage and power when lifting still heavier window coverings or shades 1. The auxiliary gearboxes 22 increase and improve lifting power by gearing down in approximately a two to one (2-1) ratio. This ratio, however, may vary without departing from the scope and spirit of the instant invention.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A dual motor powered window covering assembly device, said device comprising:

an extendable and retractable window covering supported by at least one cord and comprising a load having a certain weight;

a control motor;

a slave motor;

an electrical power source for providing electrical power to said control motor and said slave motor;

a shaft joining said control motor and said slave motor, said shaft having a first end mechanically coupled to said control motor and a second end in mechanical communication with said slave motor;

said shaft being configured to be rotated by said control motor and said slave motor, said control motor and said slave motor being configured to share said weight of said window covering;

a power cable electrically communicating said control motor and said slave motor so that said control motor and said slave motor rotate cooperatively to rotate said shaft in a same direction;

at least one cord spool supporting said cord, said cord winding around said cord spool when said shaft is rotated in a first direction to retract said window covering and unwinding from said cord spool when said shaft is rotated in a second direction to extend said window covering;

a stop means, in communication with said shaft and said motors, for halting rotation of said shaft when said shaft has rotated a predetermined distance to cease retraction of said window covering; and a shaft rotation synchronization control means, in mechanical communication with said slave motor, for causing said slave motor to rotate in a direction opposite said control motor such that said control motor and said slave motor rotate said shaft in the same direction.

2. The window covering assembly device of claim 1, wherein said shaft rotation synchronization control means comprises:

said power cable being electrically coupled to said slave motor with a reverse polarity compared to said control motor.

3. The window covering assembly device of claim 1, wherein said shaft rotation synchronization control means comprises:

an offset gear box mechanically communicated with said slave motor to cause said shaft to rotate in a direction dictated by said control motor.

4. The window covering assembly device of claim 1, wherein said stop means for halting rotation of said shaft comprises:

a stop assembly in mechanical communication with said shaft, said stop assembly having a limit spool configured to travel in said stop assembly until it reaches a predetermined point to cause said motors to stop.

5. The window covering assembly device of claim 1, wherein said control motor and said slave motor comprise electrical motors.

6. The window covering assembly device of claim 1, wherein said control motor and said slave motor comprise electrical DC motors.

7. The window covering assembly device of claim 1, further comprising:

a headrail cover mountable over said assembly device for covering said assembly device.

8. The window covering assembly device of claim 4, further comprising:

a second cord spool supporting a second cord wherein said second cord at least partially supports said window covering, said second cord winding around said second cord spool when said shaft is rotated in a first direction to retract said window covering and unwinding from said second cord spool when said shaft is rotated in a second direction to extend said window covering.

9. The window covering assembly device of claim 1, further comprising:

at least one lift gear box mechanically coupled to said shaft and in mechanical communication with said slave motor.

10. The window covering assembly device of claim 1, further comprising:

a control side gear box mechanically coupled to said shaft and said control motor; and a slave side gear box mechanically coupled to said shaft and said slave motor.

11. A dual motor powered window covering assembly device, comprising:

an extendable and retractable window covering supported by a first cord and a second cord and comprising a load having a certain weight;

a control motor;

a slave motor;

an electrical power source for providing electrical power to said control motor and said slave motor;

a shaft joining said control motor and said slave motor, said shaft having a first end mechanically coupled to said control motor and a second end in mechanical communication with said slave motor;

said shaft being configured to be rotated by said control motor and said slave motor, said control motor and said slave motor being configured to share said weight, of said window covering;

a power cable electrically communicating said control motor and said slave motor so that said control motor and said slave motor rotate cooperatively to rotate said shaft in a same direction;

a first cord spool mounted to said shaft and supporting said first cord;

a second cord spool mounted to said shaft and supporting said second cord, said first cord being configured to wind around said first cord spool and said second cord being configured to wind around said second cord spool when said shaft is rotated in a first direction to retract said window covering and said first cord being configured to unwind from said first cord spool and said second cord being configured to unwind from said second cord spool when said shaft is rotated in a second direction to extend said window covering;

a stop means, in communication, with said shaft and said motors, for halting rotation of said shaft when said shaft has rotated a predetermined distance to cease retraction of said window covering; and a shaft rotation synchronization control means, in mechanical communication with said slave motor, for causing said slave motor to rotate in a direction opposite said control motor such that said control motor and said slave motor rotate said shaft in the same direction.

12. The window covering assembly device of claim 11, wherein said shaft rotation synchronization control means comprises:

said power cable being electrically coupled to said slave motor with a reverse polarity compared to said control motor.

13. The window covering assembly device of claim 11, wherein said shaft rotation synchronization control means comprises:

an offset gear box mechanically communicated with, said slave motor to cause said shaft to rotate in a direction dictated by said control motor.

14. The window covering assembly device of claim 11, wherein said stop means for halting rotation of said shaft comprises:

a stop assembly in mechanical communication with said shaft, said stop assembly having a limit spool configured to travel in said stop assembly until it reaches a predetermined point to cause said motors to stop.

15. The window covering assembly device of claim 11, wherein said control motor and said slave motor comprise electrical motors.

16. The window covering assembly device of claim 11, wherein said control motor and said slave motor comprise electrical DC motors.

17. The window covering assembly device of claim 11, further comprising:

a headrail cover mountable over said assembly device for covering said assembly device.

18. The window covering assembly device of claim 11, further comprising:

at least one lift gearbox mechanically coupled to said shaft and in mechanical communication with said control motor.

19. The window covering assembly device of claim 11, further comprising:

a control side gear box mechanically coupled to said shaft and said control motor; and a slave side gear box mechanically coupled to said shaft and said slave motor.

20. The window covering assembly device of claim 11, further comprising:

a wireless remote control transmitter for operating said control and slave motors and electrical and mechanical circuitry adapted to store positional information of said window covering.

* * * * *